US008978919B2

(12) United States Patent
Yang et al.

(10) Patent No.: US 8,978,919 B2
(45) Date of Patent: Mar. 17, 2015

(54) GAS STORAGE CARTRIDGE

(75) Inventors: Jefferson YS Yang, Orange, CA (US); Cheng-Ham Liao, Miaoli (TW); Feng-Hsiang Hsiao, Miaoli (TW); Tzu-Wei Kuo, Miaoli (TW)

(73) Assignee: Asia Pacific Fuel Cell Technologies, Ltd., Miaoli (TW)

( * ) Notice: Subject to any disclaimer, the term of this patent is extended or adjusted under 35 U.S.C. 154(b) by 0 days.

(21) Appl. No.: 13/332,704

(22) Filed: Dec. 21, 2011

(65) Prior Publication Data

US 2012/0160711 A1 Jun. 28, 2012

(30) Foreign Application Priority Data

Dec. 23, 2010 (TW) ..... 099145542 A

(51) Int. Cl.
*F17C 1/00* (2006.01)
*F17C 11/00* (2006.01)

(52) U.S. Cl.
CPC ..... *F17C 11/005* (2013.01); *F17C 11/00* (2013.01)
USPC ..... 220/581; 220/501

(58) Field of Classification Search
USPC ..... 220/581, 4.26, 509, 507, 23.88; 206/0.7; 141/98; 210/282, 489
See application file for complete search history.

(56) References Cited

U.S. PATENT DOCUMENTS 4,032,457 A * 6/1977 Matchett ..... 210/489
4,667,815 A * 5/1987 Halene ..... 206/0.7
4,819,718 A * 4/1989 Ishikawa et al. ..... 165/104.12
5,076,430 A * 12/1991 Philpot ..... 206/430
5,953,922 A 9/1999 Stetson et al.
6,626,323 B2 * 9/2003 Stetson et al. ..... 220/577
6,706,183 B2 * 3/2004 Ito et al. ..... 210/416.1
6,709,497 B2 * 3/2004 Myasnikov et al. ..... 96/126
6,742,650 B2 * 6/2004 Yang et al. ..... 206/0.7
6,991,770 B2 * 1/2006 Suzuki et al. ..... 422/198
7,211,228 B2 * 5/2007 Suzuki et al. ..... 422/198
7,431,756 B2 * 10/2008 Myasnikov et al. ..... 96/126
7,947,119 B2 * 5/2011 Golz et al. ..... 95/116
2003/0019765 A1 1/2003 Yang et al.
2003/0215684 A1 * 11/2003 Yang et al. ..... 429/26
2004/0020844 A1 * 2/2004 Rynbeck ..... 210/489
2010/0219087 A1 * 9/2010 Fujita et al. ..... 206/7
2010/0224066 A1 * 9/2010 Ophir et al. ..... 96/10

FOREIGN PATENT DOCUMENTS

CN 1405484 3/2003
DE 112008001274 3/2010
FR 2931142 11/2009
WO 02061249 8/2002

* cited by examiner

*Primary Examiner* — Anthony Stashick
*Assistant Examiner* — James Way
(74) *Attorney, Agent, or Firm* — Kirton McConkie; Evan R. Witt

(57) ABSTRACT

A gas storage cartridge includes a sealed cartridge unit for storing a gas storage material. The gas storage cartridge is defined by a first slab, a peripheral wall, and a second slab. At least one gas-guiding channel is accommodated within a receptacle of the gas storage cartridge. The first slab has a first gas inlet/outlet port and the second slab has a second gas inlet/outlet port aligned with the gas-guiding channel. Consequently, a gas is guided into the receptacle through the gas-guiding channel to be adsorbed by the gas storage material within the receptacle of the gas storage cartridge. Alternatively, the gas released from the gas storage material can be guided to the first gas inlet/outlet port and the second gas inlet/outlet port through the gas-guiding channel.

10 Claims, 8 Drawing Sheets

GAS STORAGE CARTRIDGE

FIELD OF THE INVENTION

The present invention relates to a gas storage cartridge of a gas storage canister, and more particularly to a modular gas storage cartridge, which a plurality of gas storage cartridges are stacked over each other and accommodated within a gas storage canister.

BACKGROUND OF THE INVENTION

A fuel cell is a device that converts the chemical energy from a hydrogen-containing fuel into electricity through a chemical reaction with air. Consequently, the fuel cell is categorized as a new energy source. The hydrogen-containing fuel used in the fuel cell includes any type of hydrocarbon such as natural gas, methanol, ethanol (alcohol), product from water hydrolysis, marsh gas, or the like.

The hydrogen gas is usually filled into a gas storage canister with metal hydride, so that the hydrogen gas is adsorbed and stored by the metal hydride. For using the hydrogen gas, the gas storage canister should be properly heated to release the hydrogen gas to the application device. Consequently, the fuel cell manufacturers make efforts in designing novel gas storage canisters for providing more stable and sustained hydrogen gas.

Conventionally, the gas storage material (e.g. metal hydride) is directly accommodated within a canister body of the gas storage canister. Since the gas storage material is usually in a powdery form and the gas storage material is accommodated within a single receptacle of the canister body, if the volume of the gas storage material is too large, the gas storage material fails to be uniformly and stably heated. Under this circumstance, the efficiency of releasing the gas (e.g. the hydrogen gas) from the gas storage material is deteriorated. For solving these drawbacks, the researchers are devoted to the methods of partitioning the gas storage material within the gas storage canister. Unfortunately, these methods are unsatisfied because the thermal expansion of the gas storage material may result in deformation of the partition articles. Under this circumstance, the gas storage material may be leaked to and stacked over other partition layers or a non-uniform heating problem may occur, so that the performance of the gas storage canister is impaired.

Moreover, it is inconvenient to fill the gas storage material into the gas storage canister because a special jig tool is indispensable. The process of filling the gas storage material is complicated, and needs to be performed by a professional technician. In addition, a difference of gas storage material between any two different filling processes is easily generated. Under this circumstance, the operating performance of the gas storage canister is adversely affected.

SUMMARY OF THE INVENTION

A first object of the present invention provides a modular gas storage cartridge comprising a sealed cartridge unit and a gas-guiding channel. The gas storage cartridge is used for accommodating a gas storage material. Since the gas storage cartridge is modularized to facilitate production, assembly and application, the problems encountered from the prior art will be obviated.

A second object of the present invention provides a simplified gas storage canister. After the modular gas storage cartridges are successively stacked over each other and accommodated within the inner space of the gas storage canister, the gas storage canister is assembled without difficulty.

A third object of the present invention provides a gas storage cartridge which is easily assembled and stably positioned. After several modular gas storage cartridges are successively stacked over each other and accommodated within the inner space of the gas storage canister, these gas storage cartridges are aligned with each other and positioned by simple positioning elements or positioning structures.

A fourth object of the present invention provides a gas storage cartridge with a compartment structure. The compartment structure is accommodated within the modular gas storage cartridge and has a plurality of compartments for storing a predetermined amount of gas storage material. Consequently, the gas storage material can be optimally distributed and uniformly heated, and the structural strength of the gas storage cartridge is enhanced.

A fifth object of the present invention provides a gas storage cartridge with a gap. Due to the gap between the top and inner peripheries of the gas storage cartridge, the possibility of resulting in deformation of the partition articles will be minimized.

In accordance with an aspect of the present invention, there is provided a gas storage canister. The gas storage canister includes a plurality of gas storage cartridges. Each of the gas storage cartridges includes a sealed cartridge unit for storing a gas storage material. The gas storage cartridge is defined by a first slab, a peripheral wall, and a second slab. At least one gas-guiding channel is accommodated within the receptacle of the gas storage cartridge. The first slab has a first gas inlet/outlet port and the second slab has a second gas inlet/outlet port aligned with the gas-guiding channel. Consequently, a gas is guided into the receptacle through the gas-guiding channel to be adsorbed by the gas storage material within the receptacle of the gas storage cartridge. In addition, the gas released from the gas storage material can be guided to the first gas inlet/outlet port and the second gas inlet/outlet port through the gas-guiding channel.

The gas-guiding channel includes a first connecting part, a second connecting part, and a filtering layer. The first connecting part has at least one gas-guiding hole. The first connecting part and second connecting part may be coupled with each other. The filtering layer is sheathed around a tube wall of the first connecting part. The first connecting part is a porous material. Moreover, the gas storage cartridge further includes a compartment structure. The compartment structure includes a plurality of compartments, which are defined by a plurality of partition plates vertical to the first slab. Each of the compartments stores a predetermined amount of gas storage material.

By means of the present technology, the gas storage canister can be easily assembled by successively accommodating the stacked gas storage cartridges within the canister body without the need of using the complicated assembling process. Since the gas storage material has been precisely and previously filled into each modular gas storage cartridge, the difference of gas storage material between any two different filling processes will be largely reduced, the assembling complexity and difficulty will be reduced, and the possibility of resulting in deformation will be minimized. By using the gas storage canister of the present invention, each modular gas storage cartridge is uniformly and stably heated. Consequently, the efficiency of charging or releasing the gas (e.g. the hydrogen gas) is enhanced. Since there is a buffering space between any two adjacent stacked gas storage cartridges, even if the gas storage material is suffered from thermal expansion, the deformation of the canister body will be minimized. Consequently, the safety of operating the canister body is enhanced.

In the modular gas storage cartridge of the present invention, a predetermined amount of gas storage material is accommodated within the compartment of the compartment structure, so that the gas storage material is locally distributed. Consequently, during operation of the fuel cell system, the gas storage canister allows the external heat to be uniformly conducted to the compartments of all compartment structures. Since the heat applied to the inner portion and the outer portion of the gas storage material are not obviously distinguished during the heating stage, the released gas can be outputted more uniformly and stably. Under this circumstance, the operating efficacy of the present invention is enhanced. Moreover, since the compartment structure is accommodated within the receptacle of the gas storage cartridge and the partition plate is effective to reinforce the structural strength of the gas storage cartridge, the operation of the gas storage canister is more stable, and the working efficiency of the fuel cell system is enhanced. In such way, the gas storage cartridge is modularized to facilitate production, assembly and application, so that the industrial utilization is enhanced.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
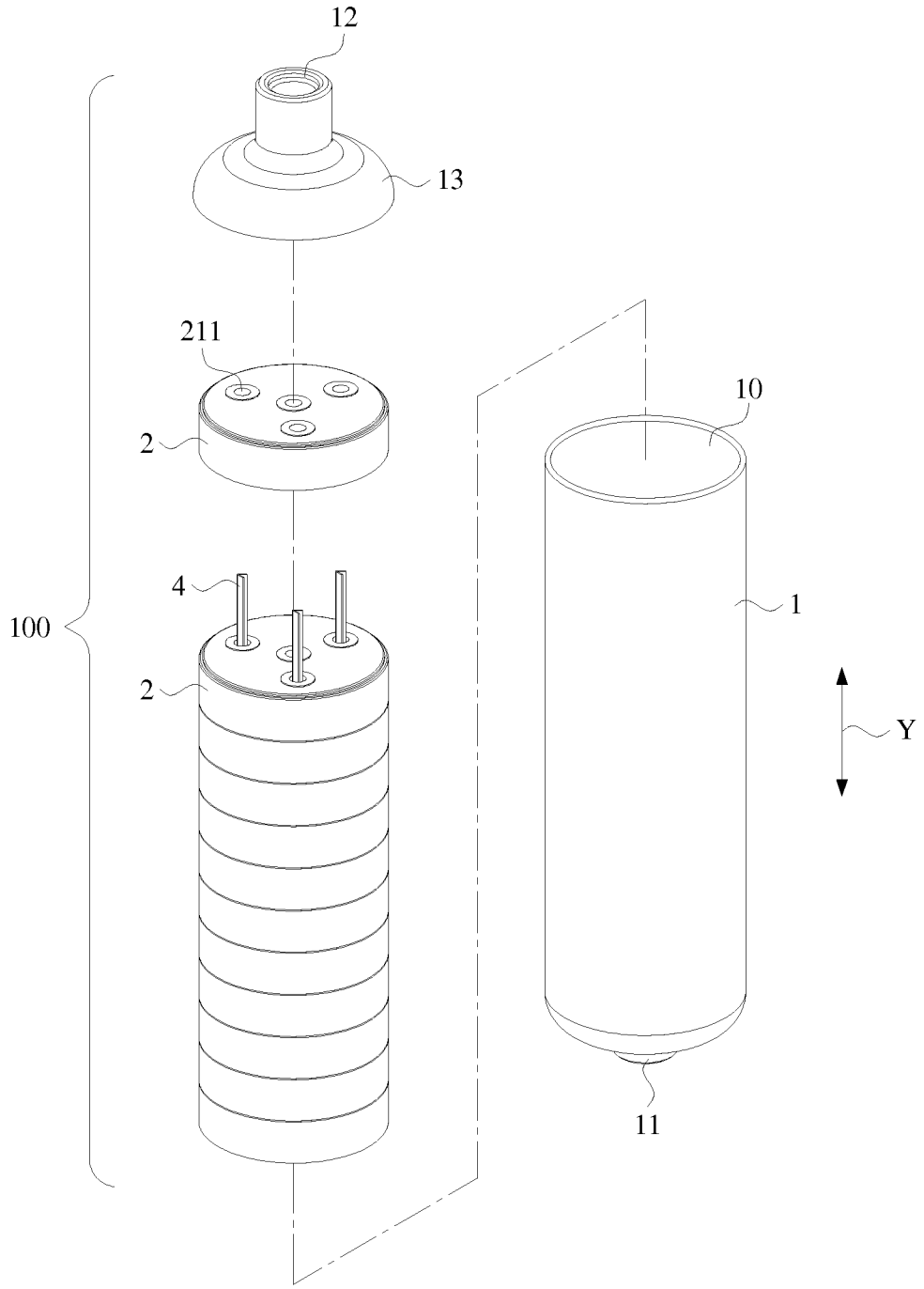
FIG. 1 is a schematic exploded view illustrating a gas storage canister according to a first embodiment of the present invention.
Figure 2:
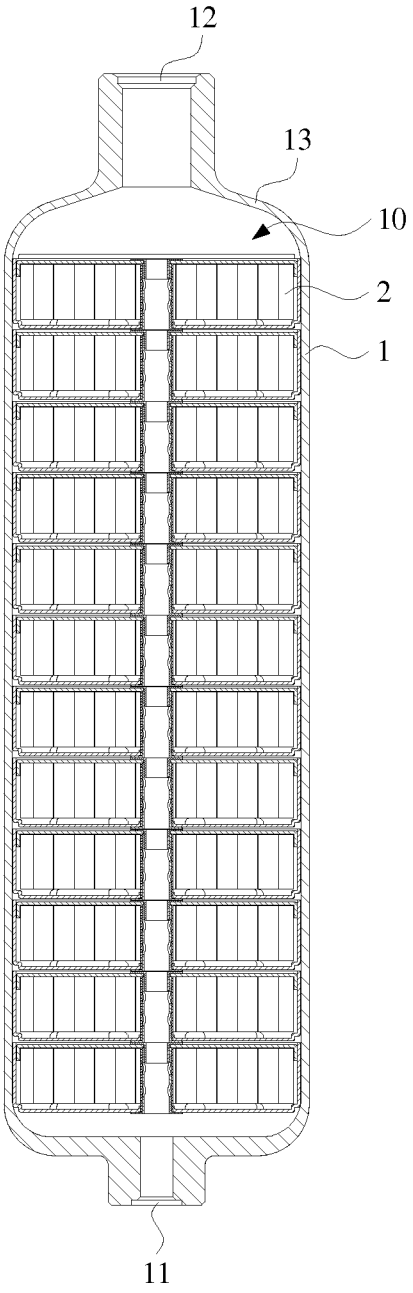
FIG. 2 is a schematic cross-sectional view illustrating the gas storage canister according to the first embodiment of the present invention.

FIG. 1 is a schematic exploded view illustrating a gas storage canister according to a first embodiment of the present invention. FIG. 2 is a schematic cross-sectional view illustrating the gas storage canister according to the first embodiment of the present invention. The gas storage canister 100 comprises a canister body 1 and a plurality of gas storage cartridges 2. The gas storage cartridges 2 are stacked over each other and accommodated within an inner space 10 of the canister body 1. The canister body 1 comprises a bottom end 11 and an outlet 12 opposed to the bottom end 11. The canister body 1 has a circular, square or polygonal shape. The shape of the canister body 1 may be varied according to the practical requirements. The bottom end 11 and the outlet 12 of the canister body 1 are arranged along a long axis direction Y. The plurality of gas storage cartridges 2 are accommodated within the inner space 10 and stacked over each other along the long axis direction Y of the canister body 1. In this embodiment, the gas storage cartridges 2 are made of a thermally-conductive material.

Figure 3:
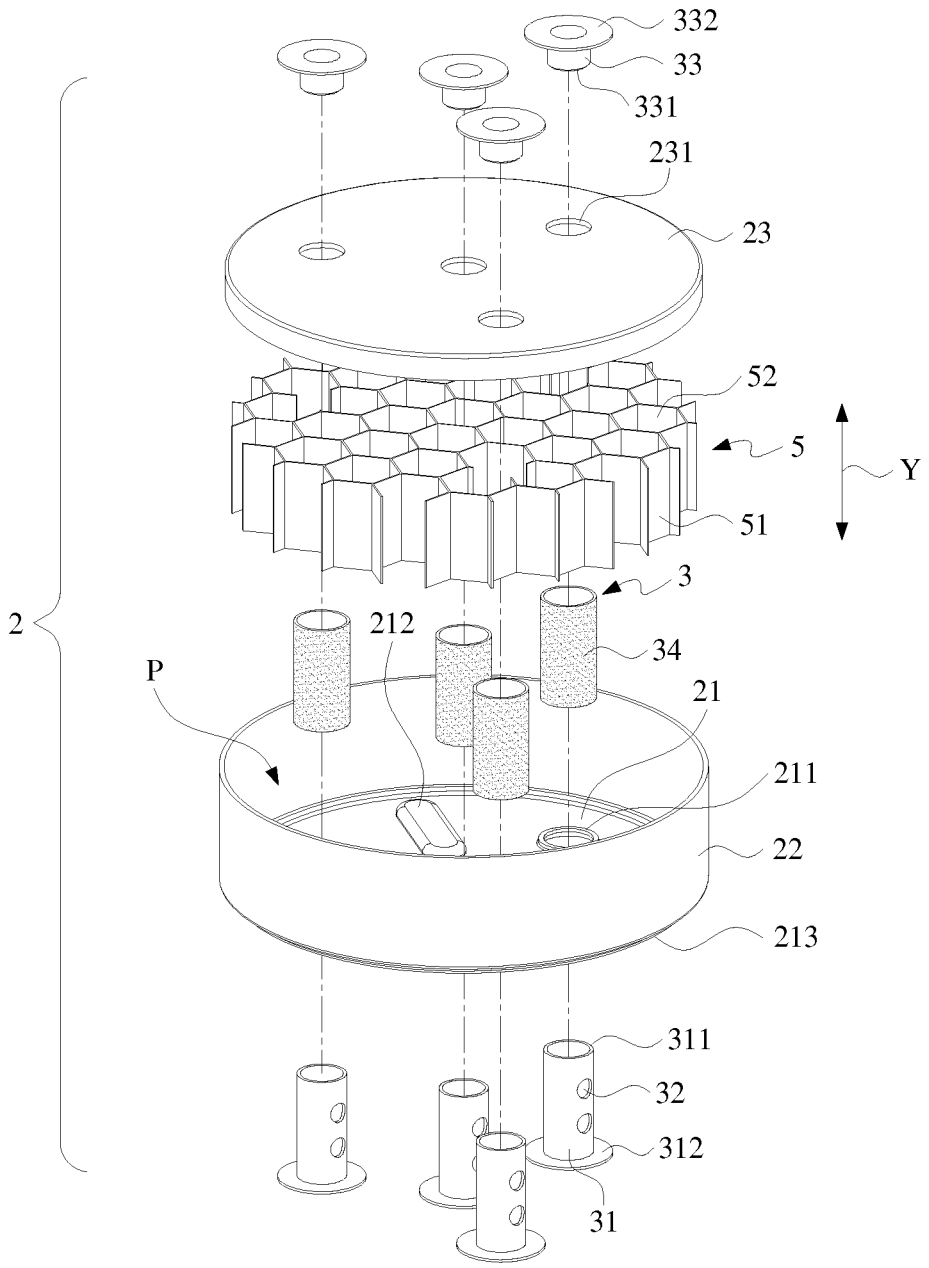
FIG. 3 is a schematic exploded view illustrating a gas storage cartridge of the gas storage canister according to the first embodiment of the present invention.

FIG. 3 is a schematic exploded view illustrating a gas storage cartridge of the gas storage canister according to the first embodiment of the present invention. As shown in FIG. 3, the gas storage cartridge 2 comprises a first slab 21, a peripheral wall 22, and a second slab 23. The first slab 21, the peripheral wall 22 and the second slab 23 are collectively defined as a sealed cartridge unit with a receptacle. The shape of the gas storage cartridge is dependent on the shape of the canister body 1. The peripheral wall 22 is vertically extended from a periphery of the first slab 21 along the long axis direction Y. The second slab 23 is disposed on the top portion of the peripheral wall 22. In an embodiment, the second slab 23 (e.g. a flat slab or a lid plate with an edge) is accommodated within the top and inner periphery of the peripheral wall 22. Consequently, a receptacle P is defined by the gas storage cartridge 2 for accommodating the gas storage material. A plurality of ribs 212 are formed on the first slab 21, so that the structural strength of the first slab 21 is enhanced. In this embodiment, a concave ring-shaped edge structure 213 is formed at a junction between the first slab 21 and the peripheral wall 22. After the plurality of gas storage cartridges 2 are stacked over each other, every two adjacent gas storage cartridges 2 are engaged with each other through the concave ring-shaped edge structure 213. Alternatively, the periphery of the concave ring-shaped edge structure 213 may have a plurality of bumps, and the peripheral wall 22 corresponding to the bumps may have positioning structures such as concave edges (not shown). Moreover, according to the practical requirements, the second slab 23 is replaced by an external lid plate, wherein the lid plate 23 is sheathed around the top and outer periphery of the peripheral wall 22. In addition, the lid plate 23 and the peripheral wall 22 may be equipped with convex/concave engaging elements or tenons in order to facilitate combination.

Furthermore, at least one gas-guiding channel 3 runs through the receptacle P of the gas storage cartridge 2. Corresponding to the gas-guiding channel 3, the first slab 21 has a first gas inlet/outlet port 211 and the second slab 23 has a second gas inlet/outlet port 231. Through the gas inlet/outlet ports 211 and 231, a supply gas can be introduced into the gas-guiding channel 3 and guided to and adsorbed by the gas storage material, which is accommodated within the gas storage cartridge 2. In addition, the gas released from the gas storage material can be guided to the gas inlet/outlet ports 211 and 231 through the gas-guiding channel 3.

After the gas storage cartridges 2 are successively stacked over and accommodated within the inner space 10 of the canister body 1, at least one positioning element 4 is penetrated through the gas-guiding channels 3 of corresponding gas storage cartridges 2 (see FIG. 1). Consequently, the gas storage cartridges 2 are stably aligned with each other, and the gas-guiding channels 3 are in communication with each other. Afterwards, the canister body 1 is necked or the top side of the canister body 1 is sealed up with a top cover. Meanwhile, the gas storage canister 100 is assembled.

In this embodiment, the gas-guiding channel 3 comprises a first connecting part 31, a second connecting part 33, and a filtering layer 34. The first connecting part 31 is a hollow tube. At least one gas-guiding hole 32 is formed in the tube wall of the first connecting part 31. A first end of the first connecting part 31 is a sustaining end 311. A second end of the first connecting part 31 is an enlarged end 312. After the sustaining end 311 of the first connecting part 31 is penetrated through the first gas inlet/outlet port 211 and the receptacle P of the gas storage cartridge 2, the sustaining end 311 is sustained against the inner surface of the second slab 23. The enlarged end 312 of the first connecting part 31 is in contact with the outer periphery of the first gas inlet/outlet port 211 of the first slab 21.

The second connecting part 33 comprises a coupling end 331 and an enlarged end 332. After the coupling end 331 of the second connecting part 33 is penetrated through the second gas inlet/outlet port 231 of the second slab 23, the coupling end 331 is fitted into the sustaining end 311 of the first connecting part 31. The enlarged end 332 of the second connecting part 33 is in contact with the outer periphery of the second gas inlet/outlet port 231 of the second slab 23.

The filtering layer 34 is sheathed around the tube wall of the first connecting part 31. In a case that the gas flows through the gas-guiding channel 3, the gas-guiding hole 32 is blocked by the filtering layer 34. Under this circumstance, the gas storage material will not be leaked out from the gas-guiding hole 32, and thus the isolating and filtering efficacy will be enhanced.

Moreover, a compartment structure 5 is disposed within the receptacle P of respective gas storage cartridge 2. The compartment structure 5 comprises a plurality of compartments 52. These compartments 52 are defined by partition plates 51 which are vertical to the first slab 21. Alternatively, these compartments 52 may be defined by parallel partition plates. Each of the compartments 52 is used for storing a predetermined amount of gas storage material. The partition plates 51 are made of a thermally-conductive material, so that the efficacy of heating the gas storage material is enhanced. In this embodiment, the compartment structure 5 is a honeycomb-like structure. The shape of the compartment structure 5 is not restricted. For example, the compartment structure 5 is a rectangular structure, a square structure, a polygonal structure, an irregular shape or a circular structure. The special profile of the compartment structure 5 can reinforce the structural strength of the gas storage cartridge 2. Consequently, when the gas storage material is suffered from thermal expansion, the deformation of the gas storage cartridge 2 is minimized.

Figure 4:
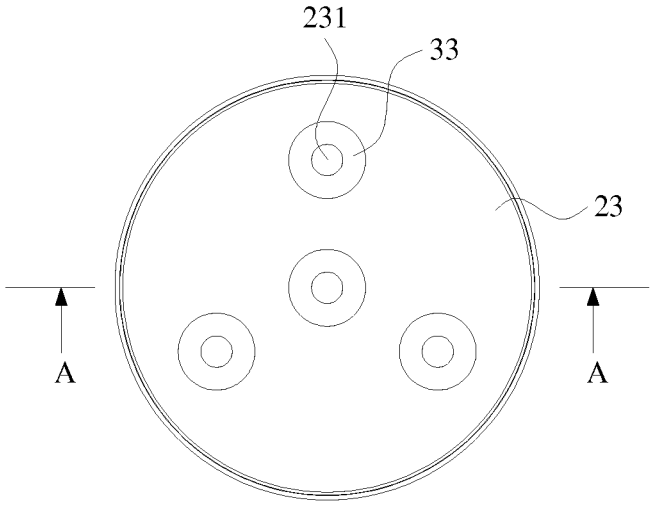
FIG. 4 is a schematic top view illustrating a gas storage cartridge of the gas storage canister according to the first embodiment of the present invention.
Figure 5:
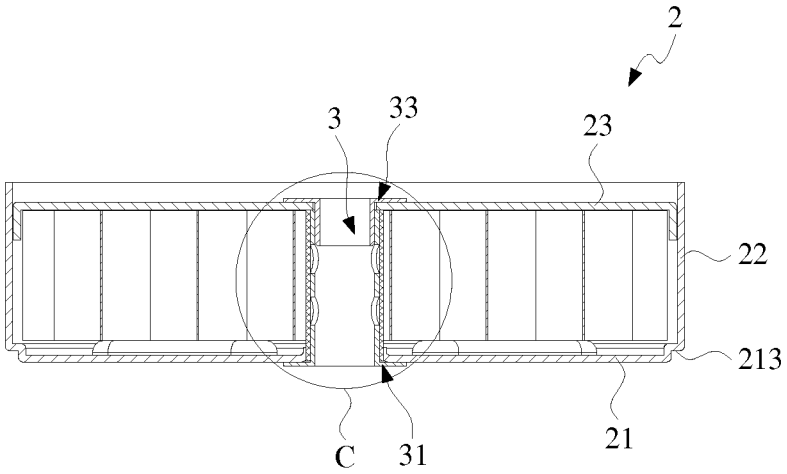
FIG. 5 is a schematic cross-sectional view illustrating the gas storage cartridge of FIG. 4 and taken along the line A-A.
Figure 6:
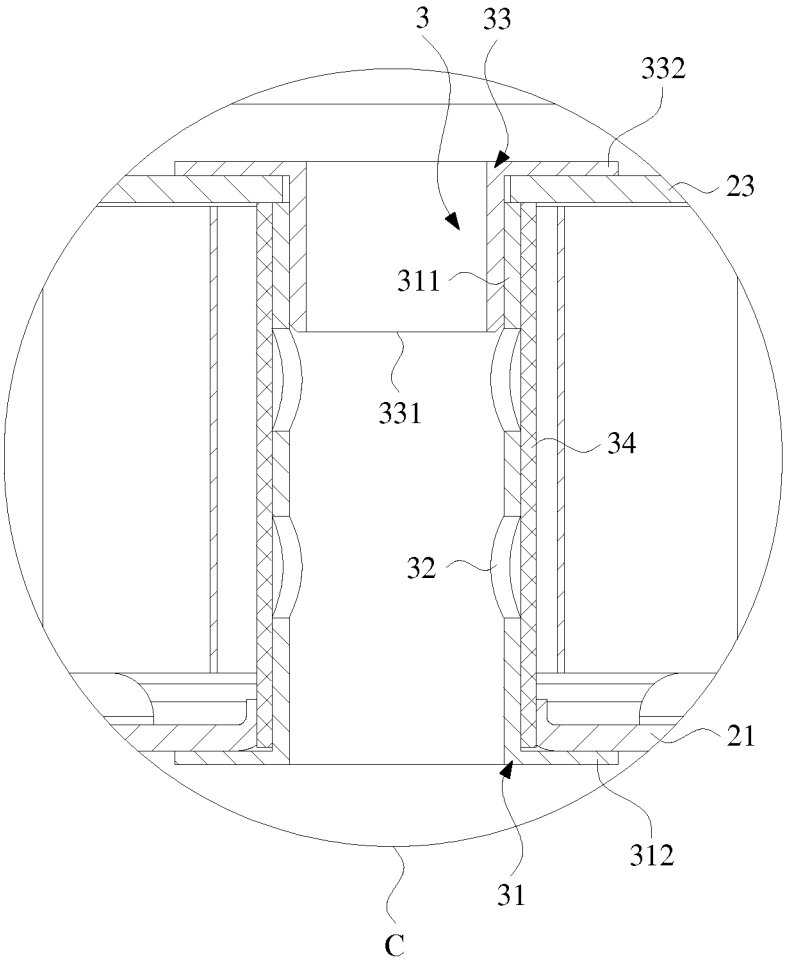
FIG. 6 is a schematic enlarged fragmentary view illustrating the portion C of FIG. 5.

FIG. 4 is a schematic top view illustrating a gas storage cartridge of the gas storage canister according to the first embodiment of the present invention. FIG. 5 is a schematic cross-sectional view illustrating the gas storage cartridge of FIG. 4 and taken along the line A-A. FIG. 6 is a schematic enlarged fragmentary view illustrating the portion C of FIG. 5. As shown in FIGS. 4, 5 and 6, a gap is formed between the second slab 23 and the top surface of the peripheral wall 22 for minimizing deformation of the cartridge unit.

Figure 7:
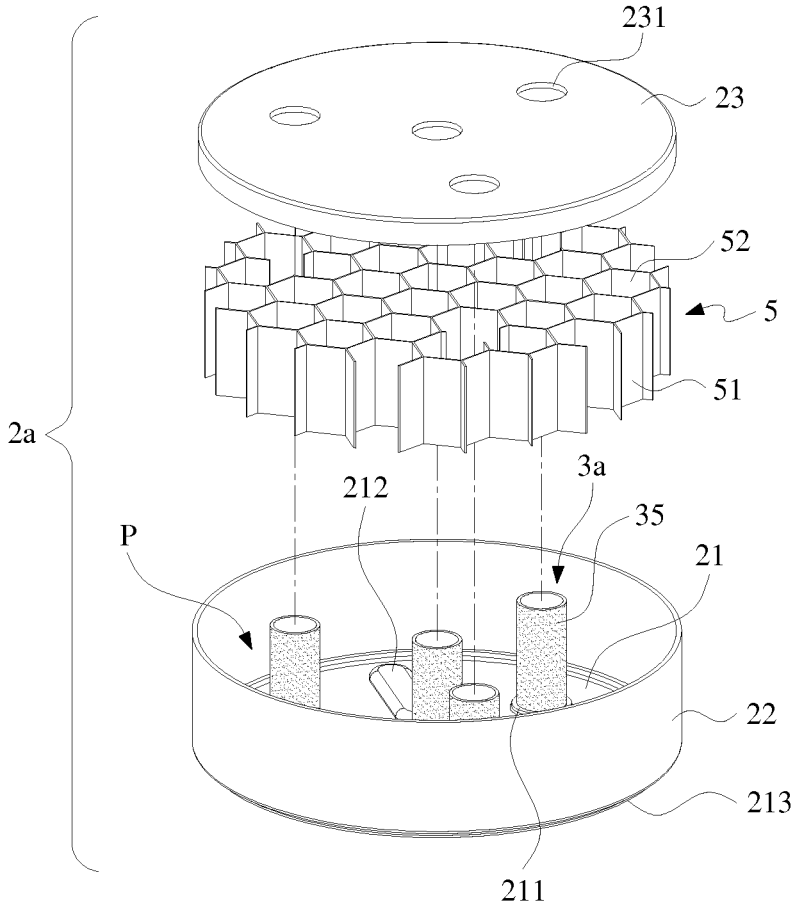
FIG. 7 is a schematic exploded view illustrating a gas storage cartridge according to a second embodiment of the present invention.

FIG. 7 is a schematic exploded view illustrating a gas storage cartridge according to a second embodiment of the present invention. The concepts of the gas storage canister of FIG. 7 are expanded from the concepts of the gas storage canister of FIG. 3. In the gas storage cartridge 2*a* of the second embodiment, the gas-guiding channel 3 which is composed of the first connecting part 31, the second connecting part 33 and the filtering layer 34 is replaced by a gas-guiding channel 3*a*. The gas-guiding channel 3*a* is a hollow rod made of porous material (or filtering material). The hollow rod 35 is accommodated within the receptacle P of the gas storage cartridge 2*a*, and arranged between the first gas inlet/outlet port 211 of the first slab 21 and the second gas inlet/outlet port 231 of the second slab 23. After the second slab 23 is sheathed by the inner periphery of the peripheral wall 22 of the first slab 21, the open end of the rod 35 is protruded out of the second gas inlet/outlet port 231 by a certain distance. In such way, the gas can be introduced into the gas storage cartridge 2*a* through the gas-guiding channel 3*a*, and the released gas can be guided to the gas inlet/outlet ports 211 and 231 through the gas-guiding channel 3*a*.

Figure 8:
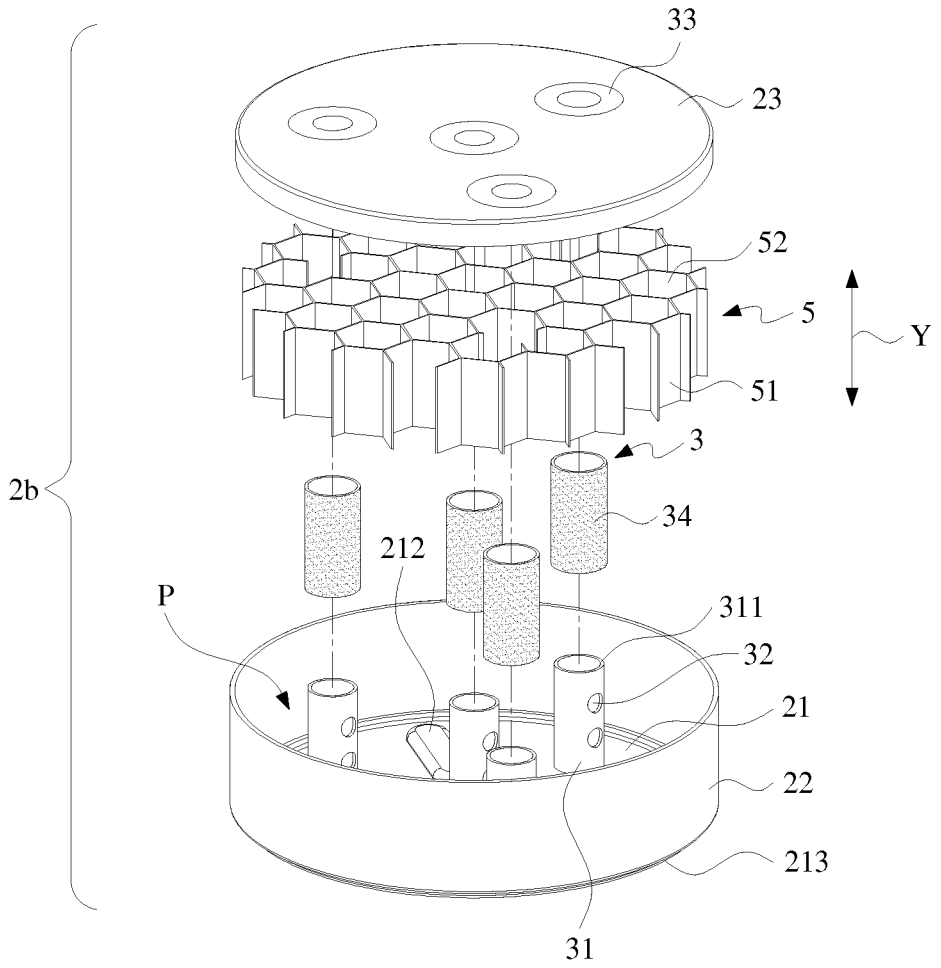
FIG. 8 is a schematic exploded view illustrating a gas storage cartridge according to a third embodiment of the present invention.

FIG. 8 is a schematic exploded view illustrating a gas storage cartridge according to a third embodiment of the present invention. In comparison with FIG. 3, the first connecting part 31 is directly formed on the first slab 21. The filtering layer 34 is sheathed around the tube wall of the first connecting part 31. In addition, the second connecting part 33 is directly formed on the second slab 23, and aligned with the first connecting part 31. The configurations of other components of the gas storage cartridge 2*b* of this embodiment are similar to those of FIG. 3, and are not redundantly described herein.

Figure 9:
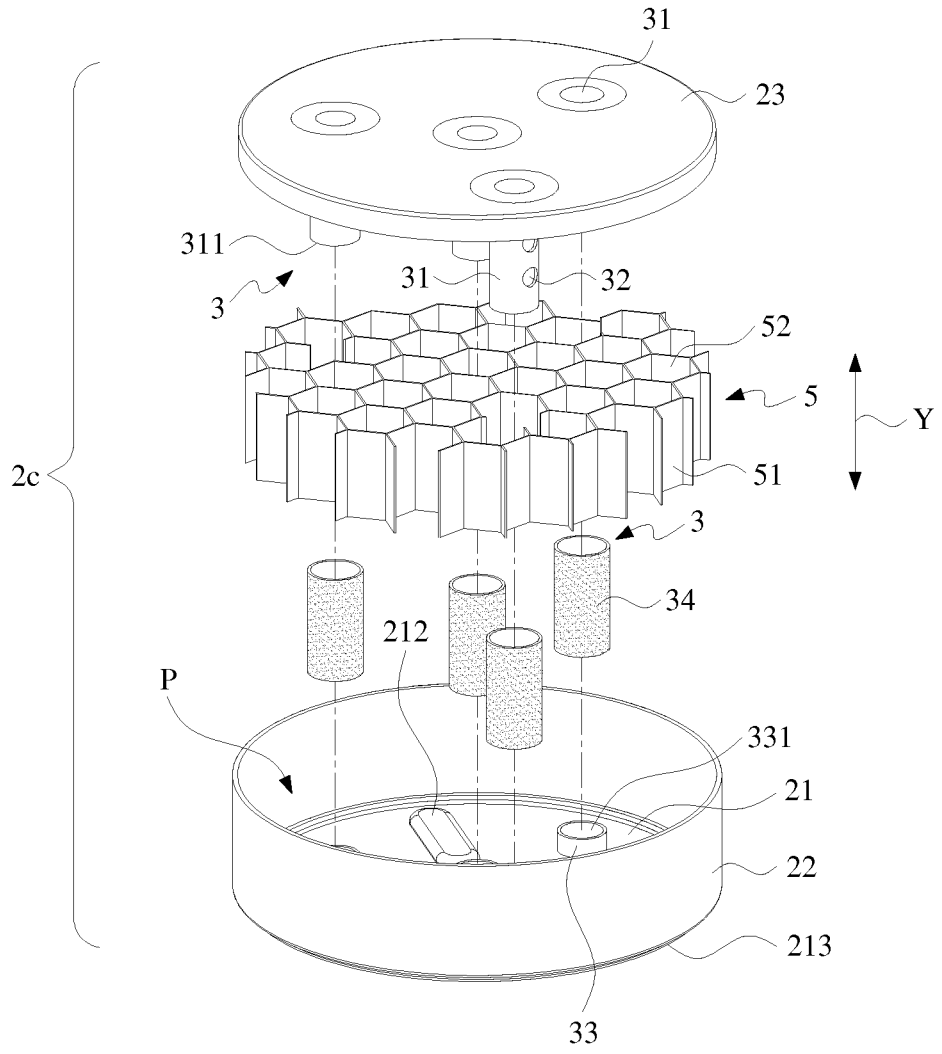
FIG. 9 is a schematic exploded view illustrating a gas storage cartridge according to a fourth embodiment of the present invention.

FIG. 9 is a schematic exploded view illustrating a gas storage cartridge according to a fourth embodiment of the present invention. In comparison with FIG. 8, the first connecting part 31 is directly formed on the second slab 23. The filtering layer 34 (or a filtering tube) is sheathed around the tube wall of the first connecting part 31. In addition, the second connecting part 33 is directly formed on the first slab 21, and aligned with the first connecting part 31. The configurations of other components of the gas storage cartridge 2*c* of this embodiment are similar to those of FIG. 8, and are not redundantly described herein.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A gas storage cartridge, comprising:

a first slab having at least a first gas inlet/outlet port;

a peripheral wall vertically extended from a periphery of said first slab;

a second slab having at least a second gas inlet/outlet port, and disposed at a top portion of said peripheral wall, wherein a receptacle is defined by said first slab, said peripheral wall and said second slab for accommodating a gas storage material, wherein said peripheral wall extends above said second slab such that a gap is formed between said second slab and a top surface of said peripheral wall; and at least one gas-guiding channel accommodated within said receptacle, wherein said first gas inlet/outlet port of said first slab and said second gas inlet/outlet port of said second slab are aligned with said gas-guiding channel, so that a gas is guided into said receptacle through said gas-guiding channel, said gas-guiding channel comprises a first connecting part and a second connecting part penetrated through said first gas inlet/outlet port and said second gas inlet/outlet port, respectively, and one of said first connecting part and said second connecting part is fitted into the other of said first connecting part and said second connecting part, and wherein said first connecting part and said second connecting part are open at both ends thereof to permit gas to pass through said gas-guiding channel.

2. The gas storage cartridge according to claim 1, wherein:

said first connecting part, which is a hollow tube, wherein at least one gas-guiding hole is formed in a tube wall of said first connecting part, a first end of said first connecting part is a sustaining end, and a second end of said first connecting part is an enlarged end, wherein after said sustaining end of said first connecting part is penetrated through said first gas inlet/outlet port and said receptacle, said sustaining end is sustained against an inner surface of said second slab, wherein said enlarged end of said first connecting part is in contact with an outer periphery of said first gas inlet/outlet port of said first slab;

said second connecting part comprising a coupling end and an enlarged end, wherein after said coupling end of said second connecting part is penetrated through said second gas inlet/outlet port of said second slab, said coupling end is fitted into said sustaining end of said first connecting part, wherein said enlarged end of said second connecting part is in contact with an outer periphery of said second gas inlet/outlet port of said second slab; and a filtering layer sheathed around said tube wall of said first connecting part.

3. The gas storage cartridge according to claim 1, wherein said gas-guiding channel is a hollow rod made of a porous material, wherein said rod is accommodated within said receptacle and aligned with said first gas inlet/outlet port of said first slab and said second gas inlet/outlet port of said second slab.

4. The gas storage cartridge according to claim 1, wherein at least one rib is formed on said first slab.

5. The gas storage cartridge according to claim 1, wherein at least one positioning element is penetrated through said gas-guiding channel, so that said gas storage cartridge is stacked over and aligned with an adjacent gas storage cartridge.

6. The gas storage cartridge according to claim 1, further comprising a compartment structure, wherein said compartment structure is accommodated within said receptacle of said gas storage cartridge, wherein said compartment structure comprises a plurality of compartments, which are defined by a plurality of partition plates vertical to said first slab, wherein each of said compartments stores a predetermined amount of gas storage material.

7. A gas storage cartridge, comprising:

a sealed cartridge unit with a receptacle, wherein said sealed cartridge unit comprises a first slab, a peripheral wall vertically extended from a periphery of said first slab, and a second slab, said receptacle is defined by said first slab, said peripheral wall and said second slab, wherein said peripheral wall extends above said second slab such that a gap is formed between said second slab and a top surface of said peripheral wall, said cartridge unit at least has a first gas inlet/outlet port and a second gas inlet/outlet port;

a compartment structure accommodated within said receptacle of said cartridge unit, wherein said compartment structure comprises a plurality of compartments, which are defined by a plurality of partition plates, wherein each of said compartments stores a predetermined amount of gas storage material; and at least one gas-guiding channel accommodated within said receptacle of said cartridge unit, wherein said gas-guiding channel is aligned with said first gas inlet/outlet port and said second gas inlet/outlet port, so that a gas is guided into said receptacle through said gas-guiding channel, said gas-guiding channel comprises a first connecting part and a second connecting part penetrated through said first gas inlet/outlet port and said second gas inlet/outlet port, respectively, and one of said first connecting part and said second connecting part is fitted into the other of said first connecting part and said second connecting part, and wherein said first connecting part and said second connecting part are open at both ends thereof to permit gas to pass through said gas-guiding channel.

8. The gas storage cartridge according to claim 7, wherein:

said first connecting part, which is a hollow tube, wherein at least one gas-guiding hole is formed in a tube wall of said first connecting part, a first end of said first connecting part is a sustaining end, and a second end of said first connecting part is an enlarged end, wherein after said sustaining end of said first connecting part is penetrated through said first gas inlet/outlet port and said receptacle of said gas storage cartridge, said enlarged end of said first connecting part is in contact with an outer periphery of said first gas inlet/outlet port of said first slab;

said second connecting part comprising a coupling end and an enlarged end, wherein after said coupling end of said second connecting part is penetrated through said second gas inlet/outlet port, said coupling end is fitted into said sustaining end of said first connecting part, wherein said enlarged end of said second connecting part is in contact with an outer periphery of said second gas inlet/outlet port; and a filtering layer sheathed around said tube wall of said first connecting part.

9. The gas storage cartridge according to claim 7, wherein said gas-guiding channel is a hollow rod made of a porous material, wherein said rod is accommodated within said receptacle of said cartridge unit and aligned with said first gas inlet/outlet port and said second gas inlet/outlet port.

10. The gas storage cartridge according to claim 7, wherein at least one positioning element is penetrated through said gas-guiding channel, so that said gas storage cartridge is stacked over and aligned with an adjacent gas storage cartridge.

* * * * *